US008360725B2

(12) United States Patent
Anguisola McFeat et al.

(10) Patent No.: US 8,360,725 B2
(45) Date of Patent: Jan. 29, 2013

(54) COOLING DUCT ARRANGEMENT WITHIN A HOLLOW-CAST CASTING

(75) Inventors: Jose Ma Anguisola McFeat, Lauchringen (DE); Erich Kreiselmaier, Stetten (CH); Christoph Nagler, Zürich (CH); Sergei Riazantsev, Nussbaumen (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 12/893,307

(22) Filed: Sep. 29, 2010

(65) Prior Publication Data

US 2011/0064585 A1 Mar. 17, 2011

Related U.S. Application Data

(63) Continuation of application No. PCT/EP2009/053108, filed on Mar. 17, 2009.

(30) Foreign Application Priority Data

Mar. 31, 2008 (CH) ..... 471/08

(51) Int. Cl.
*F01D 5/18* (2006.01)

(52) U.S. Cl. ..... 416/96 R

(58) Field of Classification Search ..... 415/115; 416/96 A, 96 R, 97 R; 165/109.1, 181, 183
See application file for complete search history.

(56) References Cited

U.S. PATENT DOCUMENTS

| | | | | |
|---|---|---|---|---|
| 5,536,143 | A * | 7/1996 | Jacala et al. | 416/96 R |
| 5,772,397 | A * | 6/1998 | Morris et al. | 415/115 |
| 6,213,714 | B1 | 4/2001 | Rhodes | |
| 6,234,754 | B1 * | 5/2001 | Zelesky et al. | 416/97 R |
| 6,602,047 | B1 | 8/2003 | Barreto et al. | |
| 6,902,372 | B2 * | 6/2005 | Liang | 415/115 |
| 7,186,084 | B2 * | 3/2007 | Bunker et al. | 416/96 R |
| 2002/0021966 | A1 | 2/2002 | Kvasnak et al. | |
| 2007/0166161 | A1 | 7/2007 | Devore et al. | |

FOREIGN PATENT DOCUMENTS

| | | | |
|---|---|---|---|
| EP | 1 091 092 | A | 4/2001 |
| EP | 1 617 043 | A1 | 1/2006 |
| EP | 1 808 574 | A2 | 7/2007 |
| WO | WO 01/00964 | A | 1/2001 |

OTHER PUBLICATIONS

International Search Report (PCT/ISA/210) for PCT/EP2009/053108 dated Jun. 16, 2009.

* cited by examiner

*Primary Examiner* — Ninh H Nguyen
*Assistant Examiner* — Liam McDowell
(74) *Attorney, Agent, or Firm* — Buchanan Ingersoll & Rooney PC

(57) ABSTRACT

A cooling passage arrangement is provided inside a hollow-cast cast part, with a flow region, delimited by at least two spaced apart cast-part walls, for a cooling medium. The flow region is divided in the flow direction into two cooling passages by at least one rib line which is connected to the two cast-part walls. At least one gap is provided along the at least one rib line. At the least one gap, two rib ends are oppositely disposed a distance apart, of which one rib end has a contour in the style of a "wish bone -"Y"-cross-section".

20 Claims, 3 Drawing Sheets

COOLING DUCT ARRANGEMENT WITHIN A HOLLOW-CAST CASTING

TECHNICAL FIELD

The invention relates to a cooling passage arrangement inside a hollow-cast cast part, with a flow region, delimited by at least two spaced apart cast-part walls, for a cooling medium, which flow region is divided in the flow direction into two cooling passages by at least one rib line which is connected to the two cast-part walls.

BACKGROUND OF THE INVENTION

Hollow-cast cast parts with cooling passage arrangements inside the walls refer within the spirit of the invention primarily to components which are to be integrated into gas and steam turbine plants and are exposed to high process temperatures for service-induced reasons and require effective cooling for avoiding thermally induced material degradations. Especially stator blades and rotor blades within turbine stages, which are directly exposed to the hot gases of a gas turbine process, constitute such cast parts. As a rule, the cooling of such blading arrangements is carried out by means of cooling air which is tapped off on the compressor side and fed via openings inside the respective blade roots into the blade airfoils, which have cavities, for cooling purposes.

Figure 2A:
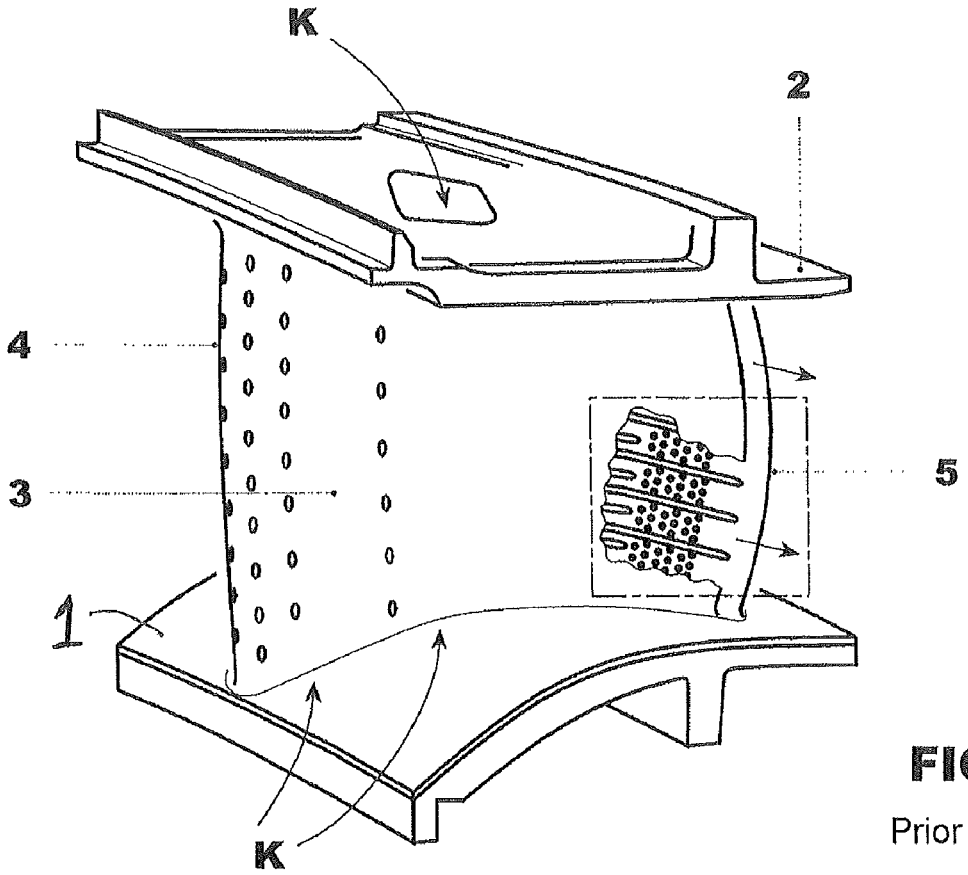
FIG. 2a Prior Art
Figure 2B:
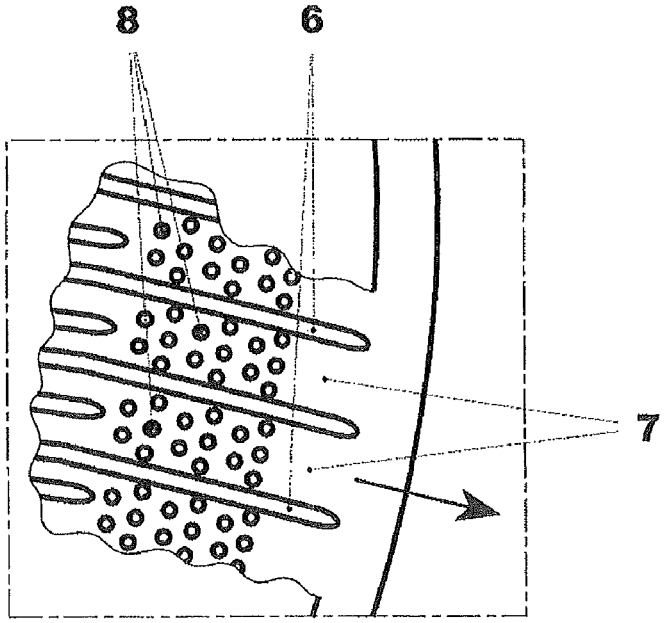
FIG. 2b Prior Art

For illustration of the previously applied cooling technique of stator blades for use in gas turbine plants reference may be made to FIGS. 2*a* and *b* which show a known per se stator blade with a stator-blade platform 1 and also a stator-blade shroud 2, between which extends the stator-blade airfoil 3 with a stator-blade leading edge 4 and a stator-blade trailing edge 5. For cooling the stator blade 3, formed hollow inside, which is shown partially cut away in FIG. 2*a* for illustrating the inner hollow cooling passage arrangement, cooling air K finds its way both through openings inside the stator-blade shroud 2 and inside the stator-blade platform 1. For effective cooling of the stator-blade airfoil 3, in the interior of the stator blade there are flow contours which ensure a thermal contact which is as intimate as possible between the supplied cooling air and the inner side, which is to be cooled, of the stator-blade wall. In particular, in the flow region directly upstream to the trailing edge 5, which is shown enlarged in FIG. 2*b*, there are rib lines 6, extending in the flow direction, which delimit individual cooling passages 7 from each other in each case. The rib lines 6, which are oriented parallel to each other, are connected in each case on both sides to the oppositely disposed stator-blade inner walls and therefore close off two directly adjacent cooling passages 7 from each other. For improving the cooling effect in this flow region, provision is made along the cooling passages 7 for a large number of individual peg-like connecting lands, so-called pins 8, between the spaced-apart oppositely disposed inner sides of the stator-blade walls, as a result of which cooling air experiences an effective mixing-through and therefore comes into intimate contact with the inner sides of the stator-blade walls.

Figure 3A:
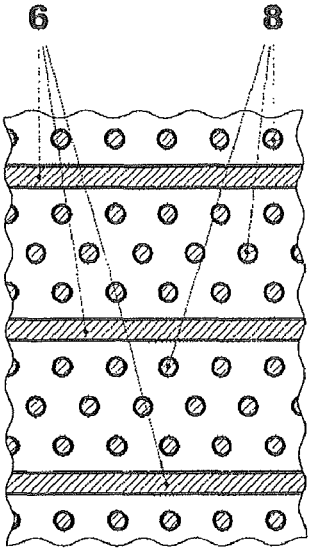
FIG. 3a Prior Art
Figure 3B:
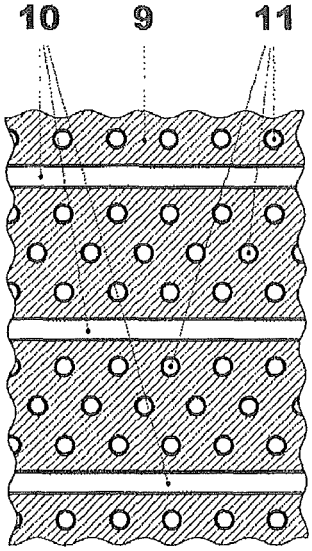
FIG. 3b Prior Art
Figure 3C:
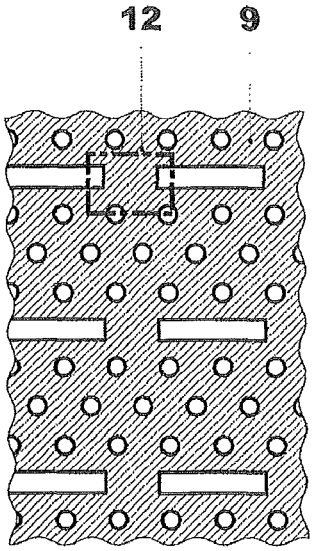
FIG. 3c Prior Art

For producing such filigrane cooling structures inside a stator blade or rotor blade which is to be produced by way of a casting process, so-called lost cores are required for the casting process, in which core the negative contours of all the structures which are to be provided inside the cast part, especially the flow contours which influence the cooling air flow, are to be incorporated. In order to form for example the rib lines 6 which are shown in the detailed view according to FIG. 2*b* and also the peg-like pins 8, which for better illustration are shown again in FIG. 3*a* in a plan view, it is necessary to provide a casting core 9, similarly shown in FIG. 3*b* in plan view, which has to be provided for creating the individual rib lines via groove-like recesses 10 and for creating through-holes 11 corresponding to the peg-like pins 8. The entirety of all the recesses which are to be provided inside the casting core 9 lead eventually to extensive perforation of the casting core and contributes decisively towards mechanical weakening of the casting core so that ultimately mechanical stability limits are reached and exceeded, these limits no longer allowing a damage-free machining and ultimately the forming of the extremely small flow contours inside the cast part. In order to stabilize the casting core, modifications have been undertaken especially during the forming of the previously described rib lines so that the casting core provides connecting lands 12, which stabilize the casting core, transversely to the longitudinal extent of the respective rib lines. As a result of this measure, however, the rib lines 6 are no longer formed continuously in the finished-cast cast part, as is to be gathered from the view in FIG. 4, but where the connecting lands 12 were provided in the casting core now have corresponding gaps 13 (see FIG. 4*b*).

Figure 4A:
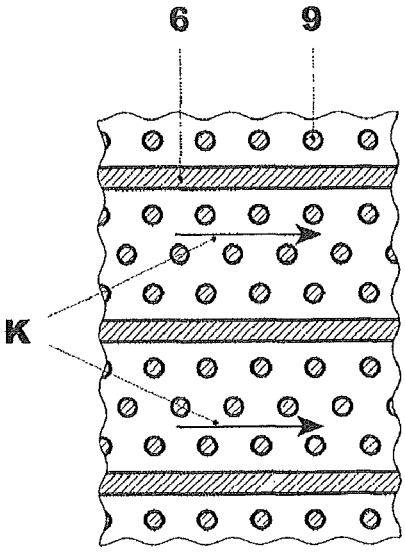
FIG. 4a Prior Art
Figure 4B:
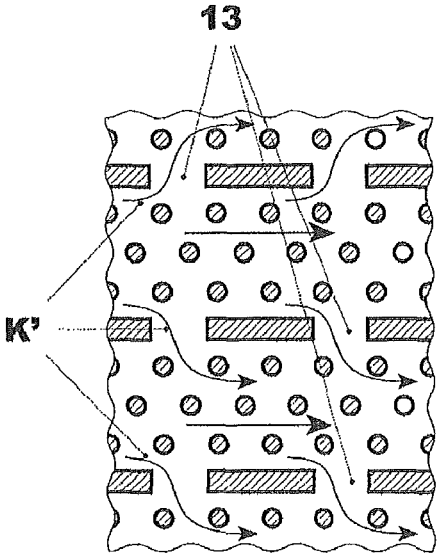
FIG. 4b Prior Art

If previously continuously formed rib lines 6 were able to completely separate the cooling air flows K contained inside the cooling passages 7 from each other, as is shown in the schematized plan view in FIG. 4*a*, then by providing corresponding gaps 13 along the rib lines 6, attributable to the stabilizing connecting lands 12 inside the casting core, cooling air flows K', which branch off through the gaps 13, now occur and are able to irritate the cooling air flow in the adjacent cooling passages. This, however, reduces the cooling efficiency of the cooling air which passes through the cooling passages 7 so that measures have to be sought with which the cooling air flow portions which pass through the gaps 13 can be avoided.

SUMMARY OF THE INVENTION

The invention is based on the object of further developing a cooling arrangement inside a hollow-cast cast part, with a flow region, delimited by at least two spaced apart cast-part walls, for a cooling medium, which flow region is divided in the flow direction into two cooling passages by at least one rib line, which is connected to the two cast-part walls, in such a way that on the one hand the adopted measures for stabilizing the casting core which is required for producing the cast part shall largely remain uninfluenced, but the cooling effect of the cooling medium which passes through the cooling passage arrangement shall be noticeably improved.

The achieving of the object which forms the basis of the invention is disclosed in the exemplary embodiments below. Advantageous features which develop the inventive idea are to be gathered from the further description with reference to the exemplary embodiments.

According to the solution, a cooling arrangement inside a hollow-cast cast part according to the features of the exemplary embodiments disclosed herein is formed in such a way that provision is made along the at the least one line of ribs for at least one gap at which two rib ends face each other in a spaced apart manner, of which one rib end has a contour in the style of a "wish bone -"Y"-cross-section". By means of such a flow contour, it is possible, as the further embodiments will show, to largely or completely prevent a flow of cooling medium through the gap along a rib line.

The measure according to the solution simply requires an additional contour along the rib line in the region of a gap, as a result of which the stability of a casting core is in no way negatively affected. Also, with the measure according to the solution it is possible to provide connecting regions between the cooling passages which are separated by the rib lines in order to realize a compact and mechanically stable casting core.

For illustration of the idea according to the solution, reference is made to the following illustrated exemplary embodiments.

BRIEF DESCRIPTION OF THE INVENTION

Figure 5:
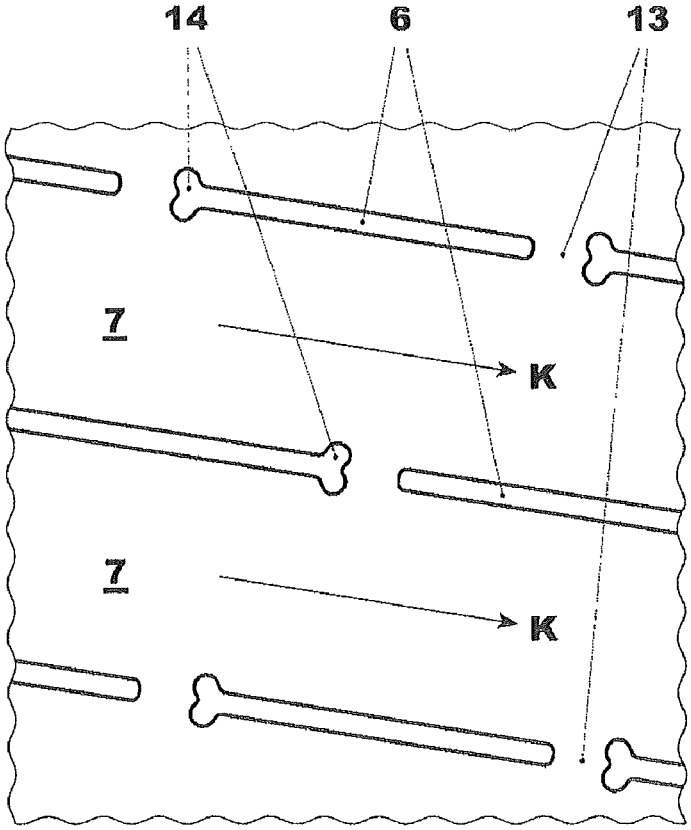

The invention is exemplarily described in the following text without limitation of the general inventive idea based on exemplary embodiments with reference to the drawing. All elements which are not essential for the direct understanding of the invention have been omitted. In the drawing FIGS. 1*a* and *b* show a plan view of a rib line in the region of a gap and also modelled flow pattern, FIGS. 2*a* and *b* show an illustration of cooling passages, according to the prior art, inside a stator blade, FIGS. 3*a, b, c*, show an illustration for forming a casting core for creating cooling passages with rib lines and peg-like pins, FIGS. 4*a* and *b* show a view of cooling-medium flow conditions along cooling passages without, and with, interrupted rib lines, and FIG. 5 shows a view of a plurality of rib lines which are formed according to the invention and extend parallel to each other.

WAYS OF IMPLEMENTING THE INVENTION, INDUSTRIAL APPLICABILITY

Figure 1A:
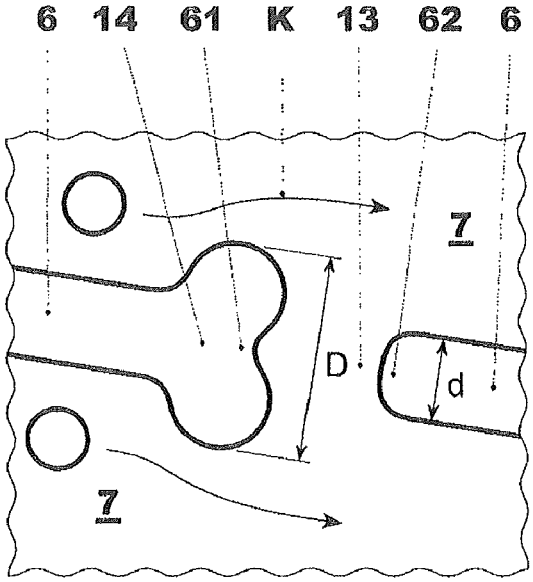

FIG. 1*a* shows the region of a gap 13 along a rib line 6, wherein two rib ends 61, 62 along the rib line 6 face each other a distance apart. In the pictorial representation according to the FIG. 1*a*, it may be assumed that a cooling medium flow K along the rib line heads in the flow direction which is indicated by means of the arrows. The rib end 61, which is provided upstream to the gap 13, in this case according to the solution has a contour 14 in the style of a wish bone -"Y"-cross-section, as a result of which the cooling medium flow K does not pass through the gaps 13 within the limits of cross-flows K', as in the illustrated exemplary case in FIG. 4*b*, but in each case flows past the gap 13 along the respective cooling passage 7 on both sides. As a result of the rib end contour 14, which is formed in the style of a wish bone -"Y"-cross-section, at the rib end 61, the flow portions which are contiguous to the rib 6 on both sides are deflected transversely to the longitudinal extent of the rib line 6. The contour 14 which is formed in the style of a wish bone -"Y"-cross-section preferably has an extent, oriented transversely to the longitudinal extent of the rib, which corresponds at least to 1.5 times the respective rib width d. The rib-end contour 14 which is formed in the style of a wish bone -"Y"-cross-section is optimized from the flow-dynamics point of view and has a surface contour which is round and therefore reduces flow resistance. The axial distance between the two oppositely disposed rib ends 61, 62 along the gap 13 should not exceed three times the length of the lateral extent D of the contour 14 which is formed in the shape of a wish bone -"Y"-cross-section.

Figure 1B:
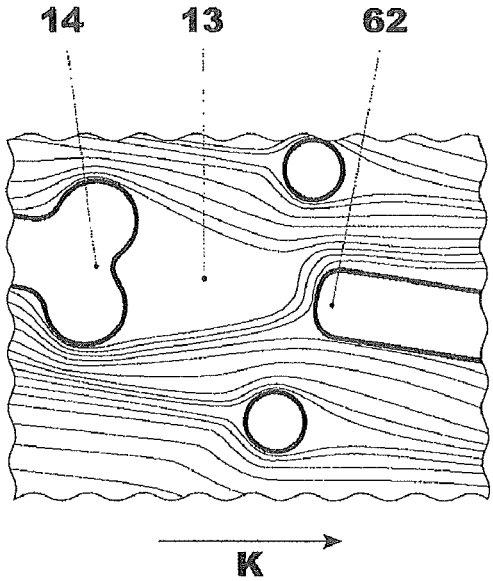

By means of the fluidic simulations, the effect of avoiding a passage of cooling medium through the respectively existing gaps 13 along a rib line 6 could be demonstrated and proven. A graphic simulation result is shown in FIG. 1*b*. Here, the dark line regions indicate the presence of cooling medium and it may be assumed that the flow region which is shown in FIG. 1*b* is exposed to throughflow with cooling medium K from left to right. As a result of the rib-end contour 14 which is formed in the style of a wish bone -"Y"-cross-section, which is formed upstream of the gap 13, those flow portions which find their way through the gap 13 from a cooling passage 7 into the adjacent cooling passage can be demonstrably reduced to a minimum. In this way, it is possible to ensure the cooling efficiency of the cooling medium K inside a cooling passage 7, despite the provision of construction-related gaps 13.

In a flow region which, as in FIG. 5, has a plurality of rib lines 6, which are oriented parallel to each other, for mutual separation of cooling passages 7, it has advantageously become apparent that particularly good flow results are achieved if the rib-end contours in the style of a wish bone -"Y"-cross-section are provided in an arrangement and distribution which is evident from FIG. 5. Here, it may be assumed that provision is made for three rib lines 6 which extend next to each other and along which gaps 13 are provided in each case for reasons of a more stable forming of the casting core. It may be additionally assumed that the cooling passages 7 which are located between the rib lines 6 are exposed to throughflow by cooling air K with the flow direction which is indicated by means of the arrows. An additional view of the pins, which are formed in a peg-like manner and located along the cooling passages 7, is dispensed with for reasons of improved clarity, although in reality these are to be correspondingly provided. Along the uppermost rib line 6 in the pictorial representation according to FIG. 5, the contours 14 which are formed in the style of a wish bone -"Y"-cross-section are provided in each case on the upstream rib end to each individual gap 13. In the middle rib line which is directly adjacent thereto, however, the dog-bone contour 14 is provided on the downstream end to each individual gap 13 along the rib line. In the lower rib line, the contours 14 which are formed in the style of a wish bone -"Y"-cross-section are again uniformly on the upstream rib end in each case at the position of each gap 13. In addition, in this rib-line arrangement it is necessary to take into consideration the fact that the gaps along a rib line in each case are not mutually overlapped by the gaps along an adjacent rib line in the direction transversely to the rib-line longitudinal extent, as is to be gathered from FIG. 5.

It could be demonstrated that with the arrangement illustrated in FIG. 5 of the rib-end contours 14 which are formed in the style of a wish bone -"Y"-cross-section, a very high cooling efficiency can be achieved, which can ultimately be accounted for by the minimizing of the flow portions which pass through the gaps 13.

LIST OF DESIGNATIONS

1 Stator blade platform
2 Stator blade shroud
3 Stator blade airfoil
4 Stator blade leading edge
5 Stator blade trailing edge
6 Rib line
7 Cooling passage
8 Pins of peg-like design
9 Casting core
10 Groove-like recess inside the casting core
11 Hole-like recesses inside the casting core
12 Connecting region, connecting land

13 Gap

14 Contour formed in the style of a wish bone -"Y"-cross-section

61, 62 Rib ends

K Cooling medium

D Lateral extent of the contour formed in the style of a wish bone -"Y"-cross-section d Rib thickness K' Cooling-medium flow portions which pass through the gap 13

The invention claimed is:

1. A cooling passage arrangement inside a hollow-cast cast part, comprising:

a flow region, which is delimited by at least two spaced apart cast-part walls, for a cooling medium;

at least one line of ribs connected to the two cast-part walls and being configured to divide the flow region in a flow direction into two cooling passages; and at least one gap arranged along the at least one line of ribs, wherein:

two rib ends face each other and are spaced from each other by the at least one gap;

one of the two rib ends has a contour in the style of a wish bone -Y-cross section and another one of the two rib ends being substantially elongate; and the contour in the style of a wish bone -Y-cross section has an extent transversely to a longitudinal extent of the at least one line of ribs which corresponds to at least 1.5 times a width which is to be assigned to the at least one line of ribs.

2. The cooling passage arrangement as claimed in claim 1, comprising:

a plurality of gaps arranged along the at least one line of ribs, wherein:

a plurality of pairs of upstream rib ends and downstream rib ends are each oppositely disposed at a corresponding one of the plurality of gaps, respectively; and along the at least one line of ribs, the contour, which is formed in the style of a wish bone -Y-cross section, is provided uniformly per gap in each case on one of an upstream rib end and a downstream rib end, among the plurality of pairs of upstream rib ends and downstream rib ends.

3. The cooling passage arrangement as claimed in claim 2, comprising:

at least two lines of ribs which extend essentially parallel to each other, wherein:

along a first one of the at least two lines of ribs, the contour, which is formed in the style of a wish bone -Y-cross section, is attached in each case uniformly on the downstream rib end per gap, and along a second one of the at least two lines of ribs, the contour, which is formed in the style of a wish bone -Y-cross section, is attached in each case uniformly on the upstream rib end per gap.

4. The cooling passage arrangement as claimed in claim 3, wherein the contour in the style of a wish bone -Y-cross section comprises two symmetrically formed protrusions which project to the side beyond a corresponding line of ribs in each case and have a round external contour which is favorable to flow.

5. The cooling passage arrangement as claimed in claim 4, comprising:

connecting lands of a peg-link design in a region of the cooling passages, the connecting lands being locally connected to the two cast-part walls.

6. The cooling passage arrangement as claimed in claim 4, wherein the cast part constitutes a stator blade or rotor blade of a rotating turbomachine.

7. The cooling passage arrangement as claimed in claim 2, comprising:

at least two lines of ribs which extend essentially parallel to each other, wherein the gaps along the at least two lines of ribs do not overlap transversely to a path of the at least two lines of ribs.

8. The cooling passage arrangement as claimed in claim 2, wherein the contour in the style of a wish bone -Y-cross section comprises two symmetrically formed protrusions which project to the side beyond a corresponding line of ribs in each case and have a round external contour which is favorable to flow.

9. The cooling passage arrangement as claimed in claim 8, comprising:

connecting lands of a peg-link design in a region of the cooling passages, the connecting lands being locally connected to the two cast-part walls.

10. The cooling passage arrangement as claimed in claim 8, wherein the cast part constitutes a stator blade or rotor blade of a rotating turbomachine.

11. The cooling passage arrangement as claimed in claim 1, wherein the contour in the style of a wish bone -Y-cross section comprises two symmetrically formed protrusions which project to the side beyond a corresponding line of ribs in each case and have a round external contour which is favorable to flow.

12. The cooling passage arrangement as claimed in claim 11, wherein the contour in the style of a wish bone -Y-cross section comprises two symmetrically formed protrusions which project to the side beyond a corresponding line of ribs in each case and have a round external contour which is favorable to flow.

13. The cooling passage arrangement as claimed in claim 12, comprising:

connecting lands of a peg-link design in a region of the cooling passages, the connecting lands being locally connected to the two cast-part walls.

14. The cooling passage arrangement as claimed in claim 12, wherein the cast part constitutes a stator blade or rotor blade of a rotating turbomachine.

15. The cooling passage arrangement as claimed in claim 14, wherein the flow region which is provided for a cooling medium is arranged inside the stator blade or rotor blade directly upstream to a trailing edge of the stator blade or rotor blade.

16. The cooling passage arrangement as claimed in claim 1, comprising:

connecting lands of a peg-link design in a region of the cooling passages, the connecting lands being locally connected to the two cast-part walls.

17. The cooling passage arrangement as claimed in claim 1, wherein the cast part constitutes a stator blade or rotor blade of a rotating turbomachine.

18. The cooling passage arrangement as claimed in claim 17, wherein the flow region is arranged inside the stator blade or rotor blade directly upstream to a trailing edge of the stator blade or rotor blade.

19. The cooling passage arrangement as claimed in claim 18, wherein the cooling medium includes cooling air.

20. The cooling passage arrangement as claimed in claim 17, wherein the rotating turbomachine includes a gas turbine.

* * * * *